US011614080B2

(12) United States Patent
Domke et al.

(10) Patent No.: US 11,614,080 B2
(45) Date of Patent: Mar. 28, 2023

(54) SUBASSEMBLY FOR A COMPRESSOR

(71) Applicant: TE Connectivity Germany GmbH, Bensheim (DE)

(72) Inventors: Daniel Domke, Frankenthal (DE); Steffen Heute, Mannheim (DE); Martin Moritz, Mannheim (DE); Simon Schemer, Speyer (DE)

(73) Assignee: TE Connectivity Germany GmbH, Bensheim (DE)

( * ) Notice: Subject to any disclaimer, the term of this patent is extended or adjusted under 35 U.S.C. 154(b) by 314 days.

(21) Appl. No.: 16/123,579

(22) Filed: Sep. 6, 2018

(65) Prior Publication Data

US 2019/0003467 A1 Jan. 3, 2019

Related U.S. Application Data

(63) Continuation of application No. PCT/EP2017/055288, filed on Mar. 7, 2017.

(30) Foreign Application Priority Data

Mar. 7, 2016 (DE) ..... 10 2016 203 688.2

(51) Int. Cl.
*F04B 27/18* (2006.01)
*F04B 49/06* (2006.01)
*F04B 49/08* (2006.01)

(52) U.S. Cl.
CPC ..... *F04B 27/1804* (2013.01); *F04B 27/18* (2013.01); *F04B 49/065* (2013.01);
(Continued)

(58) Field of Classification Search
CPC .. F04B 27/18; F04B 27/1804; F04B 27/1813; F04B 27/1818; F04B 27/1827;
(Continued)

(56) References Cited

U.S. PATENT DOCUMENTS 1,747,598 A * 10/1928 Popp ..... F16K 1/38 251/210
4,687,419 A * 8/1987 Suzuki ..... F04B 27/1804 417/222.2

(Continued)

FOREIGN PATENT DOCUMENTS

DE 10201117354 A1 5/2013
DE 102013220298 A1 4/2015

(Continued)

OTHER PUBLICATIONS

Payne, W. and O'Neal, D. (2004), A Mass Flow Rate Correlation for Refrigerants and Refrigerant Mixtures Flowing Through Short Tubes, Hvac&R Research, [online], https://tsapps.nist.gov/publication/get_pdf.cfm?pub_jd=860914 (Year: 2004).*

(Continued)

*Primary Examiner* — Devon C Kramer
*Assistant Examiner* — Joseph S. Herrmann
(74) *Attorney, Agent, or Firm* — Barley Snyder

(57) ABSTRACT

A subassembly for a compressor controls a fluid flow of a fluid between a high-pressure region and a crank chamber pressure region and between the crank chamber pressure region and a suction pressure region of the compressor. The subassembly includes a first electrical control valve, a second electrical control valve, and an electrical control device. Each of the first electrical control valve and the second electrical control valve has a valve member arranged within a valve housing and displaceable between a pair of positions. The electrical control device is adapted to control, during operation of the compressor, a fluid flow between the high-pressure region and a crank chamber pressure region and between the crank chamber pressure region and the suction pressure region by controlling the positions of the valve members.

9 Claims, 8 Drawing Sheets

(52) U.S. Cl.
CPC ..... *F04B 49/08* (2013.01); *F04B 2027/1813* (2013.01); *F04B 2027/1818* (2013.01); *F04B 2027/1831* (2013.01)

(58) Field of Classification Search
CPC ..... F04B 27/1831; F04B 2027/1813; F04B 2027/1818; F04B 2027/1827; F04B 2027/1831; F04B 49/065; F04B 49/08; F04B 2205/10; F04B 2205/11; F04B 27/10; F16K 1/38–385
See application file for complete search history.

(56) References Cited

U.S. PATENT DOCUMENTS

| | | | | |
|---|---|---|---|---|
| 5,242,274 | A * | 9/1993 | Inoue | F04B 27/1804 417/222.2 |
| 5,603,610 | A * | 2/1997 | Kawaguchi | F04B 27/1804 417/222.2 |
| 6,325,598 | B1 | 12/2001 | Sud et al. | |
| 6,443,707 | B1 * | 9/2002 | Kimura | F04B 27/1804 417/222.2 |
| 6,561,480 | B1 * | 5/2003 | Komiya | F16K 31/04 251/129.12 |
| 6,572,341 | B2 * | 6/2003 | Kimura | F04B 27/1804 417/213 |
| 6,688,853 | B1 * | 2/2004 | Burkett | F04B 27/1804 417/222.2 |
| 7,000,413 | B2 * | 2/2006 | Chen | F25B 9/008 62/190 |
| 7,063,511 | B2 * | 6/2006 | Urbank | F04B 27/1804 417/222.2 |
| 7,380,404 | B2 * | 6/2008 | Kang | F25B 49/005 62/149 |
| 8,021,124 | B2 * | 9/2011 | Umemura | F04B 27/1804 251/333 |
| 8,055,388 | B2 * | 11/2011 | Mann, III | B64F 1/34 700/276 |
| 8,950,206 | B2 * | 2/2015 | Caillat | F04B 39/06 62/259.2 |
| 2003/0029181 | A1 | 2/2003 | Terauchi | |
| 2007/0264134 | A1 * | 11/2007 | Hirota | F04B 27/1804 417/222.2 |
| 2010/0175401 | A1 * | 7/2010 | Taguchi | F04B 27/1804 62/228.3 |

FOREIGN PATENT DOCUMENTS

| | | | |
|---|---|---|---|
| EP | 0343581 | A1 | 5/1989 |
| EP | 0498552 | A1 | 1/1992 |
| EP | 0711918 | A2 | 5/1996 |
| EP | 0900937 | A2 | 3/1998 |
| EP | 0919721 | A2 | 11/1998 |
| JP | 2003-49782 | A | 2/2003 |
| JP | 2007-1/1/57 | A | 7/2007 |
| JP | 2009-7945 | A | 1/2009 |
| WO | 2009096117 | A1 | 6/2009 |

OTHER PUBLICATIONS

Korean Notice to File a Response, English translation, Korean Patent Application No. 10-2018-7028919, dated Aug. 20, 2019, 9 pages.
Abstract of JP 2007-177757, dated Jul. 12, 2007, 1 page.
PCT Notification, International Search Report and The Written Opinion of the International Searching Authority, dated Sep. 6, 2017, 22 pages.
Abstract of DE102013220298, dated Apr. 9, 2015, 1 pages.
Abstract of WO2009096117, dated Aug. 6, 2009, 2 pages.
Abstract of DE102011117354, dated May 2, 2013, 1 page.

* cited by examiner

SUBASSEMBLY FOR A COMPRESSOR

CROSS-REFERENCE TO RELATED APPLICATIONS

This application is a continuation of PCT International Application No. PCT/EP2017/055288, filed on Mar. 7, 2017, which claims priority under 35 U.S.C. § 119 to German Patent Application No. 102016203688.2, filed on Mar. 7, 2016.

FIELD OF THE INVENTION

The present invention relates to a subassembly for a compressor and, more particularly, to a subassembly for a refrigerating medium compressor.

BACKGROUND

Both the structure and the operation of refrigerating medium compressors, in particular variable lifting piston compressors, are known, for example, from German Patent Application No. 102011117354A1. In a crank housing of a refrigerating medium compressor, a large number of pistons are arranged in order to pump refrigerating medium from a suction pressure chamber into a high-pressure chamber. The movement of the pistons is guided by a rotating swash plate. If the swash plate, which is rotated by a belt drive, has a non-zero tilting angle, then rotation of the swash plate about a rotation axis thereof results in an axial lifting movement of the pistons. In this instance, refrigerating medium is drawn from the suction pressure chamber of the refrigerating medium compressor and pumped into the high-pressure chamber.

The suction pressure chamber is connected to the suction-pressure-side connection of the refrigerating medium compressor, which is itself connected in the assembled state in a motor vehicle to the suction pressure region of the air conditioning circuit; the suction pressure region of the air conditioning circuit is the output of the evaporator. The high-pressure chamber is connected to the high-pressure-side output of the refrigerating medium compressor, which is itself connected with the high-pressure region of the air conditioning system, in particular via a heat exchanger (condenser) and an expansion valve, to the input of the evaporator.

In order to adapt a conveying volume and control the refrigerating medium flow, it is known to vary the tilting angle of the swash plate in the refrigerating medium compressor. If, for example, the refrigerating medium compressor is preset for a maximum conveying volume, a reduction of the inclination angle of the swash plate brings about a reduction of the axial lifting movement of the pistons of the refrigerating medium compressor and therefore a reduction of the conveying volume.

It is further known to bring about such a control of the refrigerating medium flow by a control valve. In this instance, the refrigerating medium flow between the high-pressure region and the crank chamber pressure region is controlled with the control valve. The valve is provided with two connections in the valve housing which are connected to the high-pressure region and the crank chamber pressure region of the refrigerating medium compressor. The valve controls the refrigerating medium flow between the high-pressure region and the crank chamber pressure region.

If, for example, the valve opens in a first position the connection between the high-pressure region and the crank chamber pressure region of the refrigerating medium compressor, refrigerating medium flows through the control valve from the high-pressure region into the crank chamber pressure region; there is produced a pressure increase in the crank chamber pressure region. As a result of the pressure increase controlled by valve in the crank chamber pressure region, the swash plate is caused to pivot back. The axial lifting movement of the pistons of the refrigerating medium compressor is thereby reduced and the conveying volume of the refrigerating medium compressor is reduced. Consequently, the pressure in the high-pressure region of the air conditioning system does not continue to increase.

If the valve closes in a subsequent second position the connection between the high-pressure region and the crank chamber pressure region of the refrigerating medium compressor, refrigerating medium flows through the permanently open passage (a so-called "bleedport") which is present in the refrigerating medium compressor from the crank chamber pressure region into the suction pressure region; there is produced a pressure reduction in the crank chamber pressure region. As a result of the pressure decrease controlled by valve in the crank chamber pressure region, the swash plate is caused to pivot out or tilt. As a result, the axial lifting movement of the pistons of the refrigerating medium compressor is increased and the conveying volume of the refrigerating medium compressor is increased. The swash plate is commonly retained in a tilted starting position by resilient tension so that, in the event of a subsequent pressure decrease in the crank chamber pressure region, the swash plate again pivots into the starting position and ensures a starting position with respect to the conveying volume in the refrigerating medium compressor.

For the reduction of the conveying volume of the refrigerating medium compressor, the conventional refrigerating medium compressor requires refrigerating medium having a sufficiently high pressure in the high-pressure region. Only with sufficiently high pressure does this refrigerating medium flow by opening the valve from the high-pressure region into the crank chamber pressure region and ensures the reduction of the conveying volume at that location.

However, refrigerating medium having a sufficiently high pressure in the high-pressure region is available only when the refrigerating medium compressor conveys refrigerating medium at least temporarily, that is to say, the refrigerating medium compressor must temporarily be operated in conveying operation with the swash plate pivoted out or tilted so that refrigerating medium is conveyed from the suction pressure region to the high-pressure region and brings about a pressure increase at that location.

Such a refrigerating medium compressor can be operated only for a limited time in a state in which the conveying volume of refrigerating medium is reduced or the conveying of refrigerating medium is completely prevented. A temporary conveying operation is required in order to subsequently operate the refrigerating medium compressor in no-load operation without any conveying volume. Accordingly, the operation of the refrigerating medium compressor is inefficient particularly in no-load operation.

SUMMARY

A subassembly for a compressor controls a fluid flow of a fluid between a high-pressure region and a crank chamber pressure region and between the crank chamber pressure region and a suction pressure region of the compressor. The subassembly includes a first electrical control valve, a second electrical control valve, and an electrical control device.

Each of the first electrical control valve and the second electrical control valve has a valve member arranged within a valve housing and displaceable between a pair of positions. The electrical control device is adapted to control, during operation of the compressor, a fluid flow between the high-pressure region and a crank chamber pressure region and between the crank chamber pressure region and the suction pressure region by controlling the positions of the valve members.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
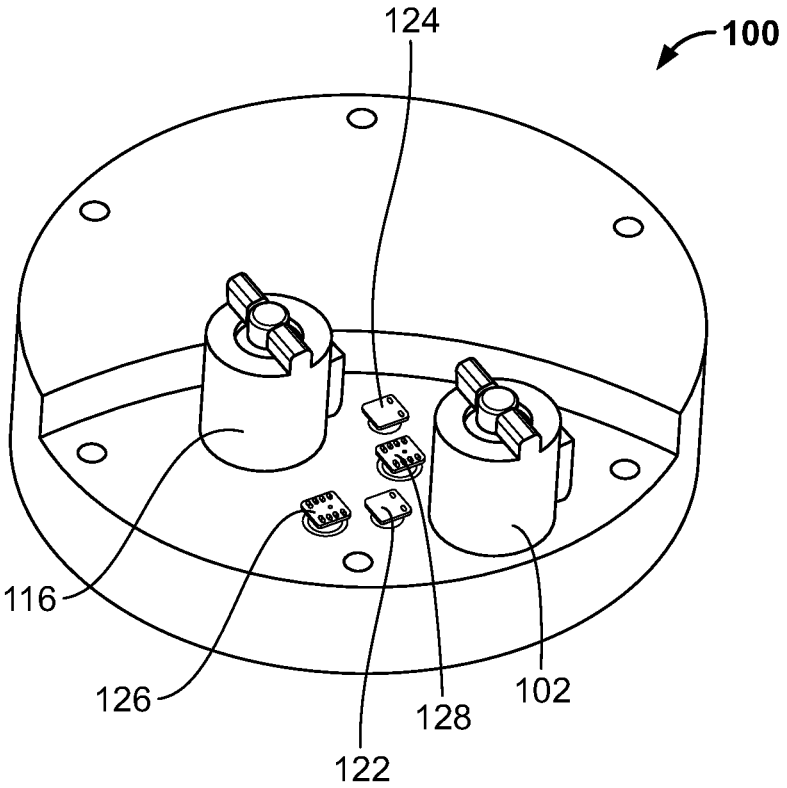
FIG. 1A is a top perspective view of a subassembly for a refrigerating medium compressor according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

Figure 1B:
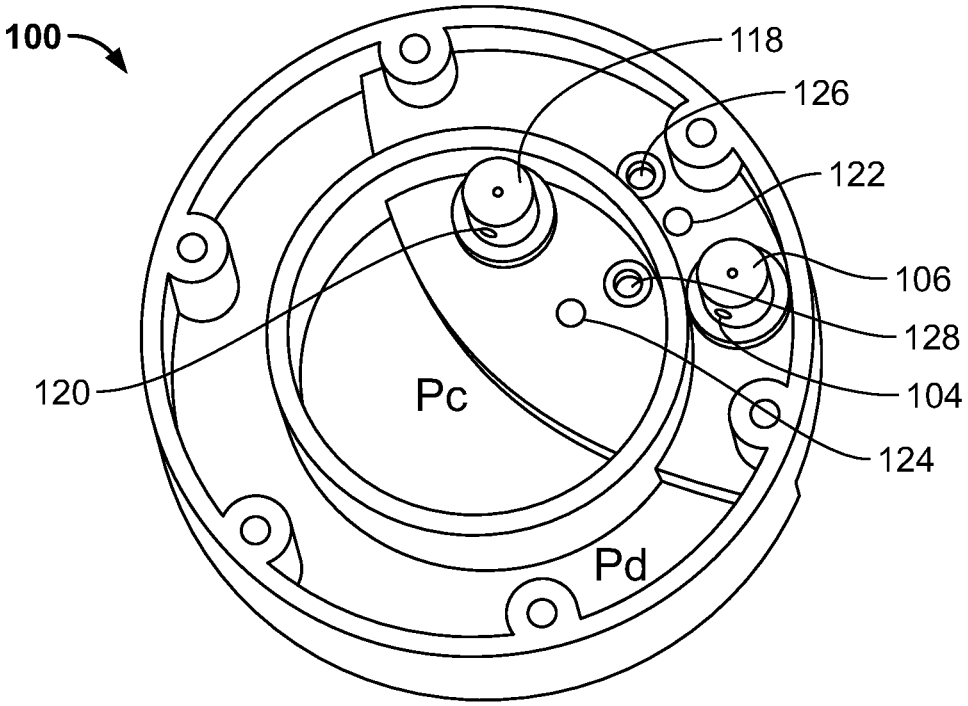
FIG. 1B is a bottom perspective view of the subassembly of FIG. 1A.
Figure 1C:
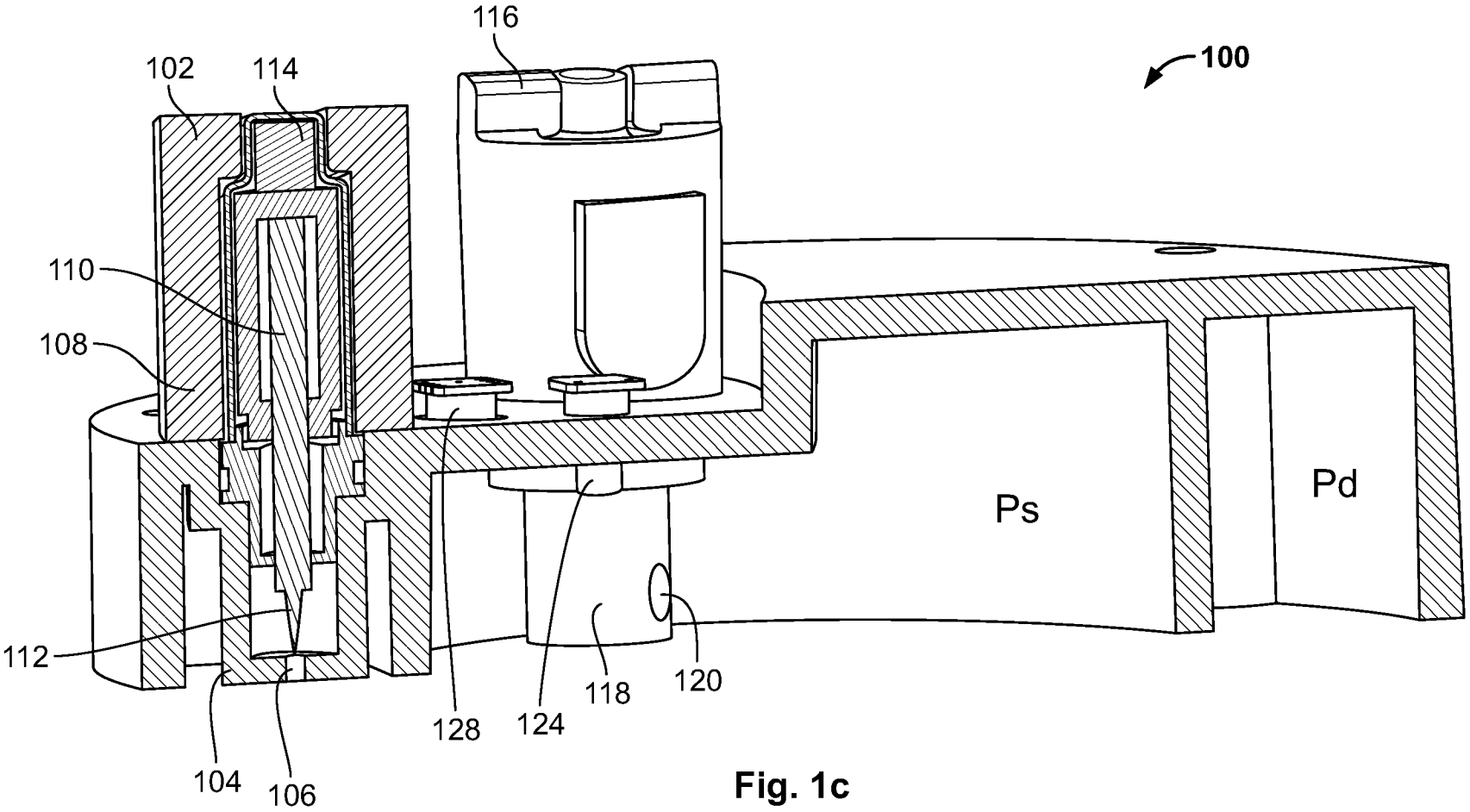
FIG. 1C is a sectional side view of the subassembly of FIG. 1A.

A subassembly 100 for a refrigerating medium compressor according to an embodiment is shown in FIGS. 1A-1C. In an embodiment, the refrigerating medium compressor is part of a motor vehicle. The subassembly 100 is used to control and optimize a refrigerating medium flow from a high-pressure region Pd via a crank chamber pressure region Pc to a suction pressure region Ps during operation of the refrigerating medium compressor.

The subassembly 100 has a first electrical control valve 102 to control a refrigerating medium flow from a high-pressure region Pd to a crank chamber pressure region Pc of the refrigerating medium compressor.

The first electrical control valve 102, as shown in FIGS. 1A-1C, has a valve housing 108 which is provided with connections 104, 106 for the high-pressure region Pd and for the crank chamber pressure region Pc. The connections 104, 106 of the first control valve 102 communicate in the fitted state with the high-pressure region Pd or crank chamber pressure region Pc of the refrigerating medium compressor. In an embodiment, the valve housing 108 of the control valve 102 already provides in the non-fitted state the corresponding connections 104, 106. Alternatively, those connections 104, 106 are constructed in the form of holes in the portion of the housing of the refrigerating medium compressor which receives the first control valve 102 in the fitted state. In this instance, the valve housing 108 is also formed by the portion of the refrigerating medium compressor housing.

The first control valve 102, as shown in FIGS. 1A-1C, has a valve member 110 which is arranged within the valve housing 108 and which can be displaced between two end positions. Depending on the position, the valve member 110 connects, separates or partially connects the two regions, in particular the high-pressure region Pd and the crank chamber pressure region Pc. In a first maximally opened position of the valve member 110 of the first control valve 102, a maximum amount of refrigerating medium flows from the high-pressure region Pd to the crank chamber pressure region Pc. In a closed, second end position of the valve member 110, any refrigerating medium flow is prevented between the two regions of the first control valve 102. The control valve 102 can also take up any positions between the two end positions, in which the refrigerating medium flow is then metered or controlled accordingly.

The valve member 110 can also take up additional positions located between the end positions within the valve housing 108. Consequently, the valve member 110 does not only take up the two positions in which the high-pressure region Pd and the crank chamber pressure region Pc are connected to each other or are separated from each other, but also additional positions in which, although the high-pressure region Pd and the crank chamber pressure region Pc are connected to each other, the flow of refrigerating medium is limited. The valve member 110 includes a closure member 112 which is constructed to be needle-like, plate-like, piston-like, conical or spherical. In the embodiment shown in FIG. 1C, the closure member 112 is constructed to be needle-like.

The subassembly 100 has a second electrical control valve 116 to control a refrigerating medium flow from the crank chamber pressure region Pc to a suction pressure region Ps of the refrigerating medium compressor.

The second electrical control valve 116, as shown in FIGS. 1A-1C, has connections 118, 120 for the crank chamber pressure region Pc and for the suction pressure region Ps. The connections 118, 120 of the second control valve 116 communicate in the fitted state with the crank chamber pressure region Pc and the suction pressure region of the refrigerating medium compressor.

The above explanations relating to the first control valve 102 also apply in a corresponding application to the second control valve 116 so that it connects, separates or partially separates the crank chamber pressure region Pc and the suction pressure region Ps with respect to each other depending on the position of a valve member of the second control valve 116 which is arranged within a valve housing of the second control valve 116 and which can be displaced between two positions.

Figure 1D:
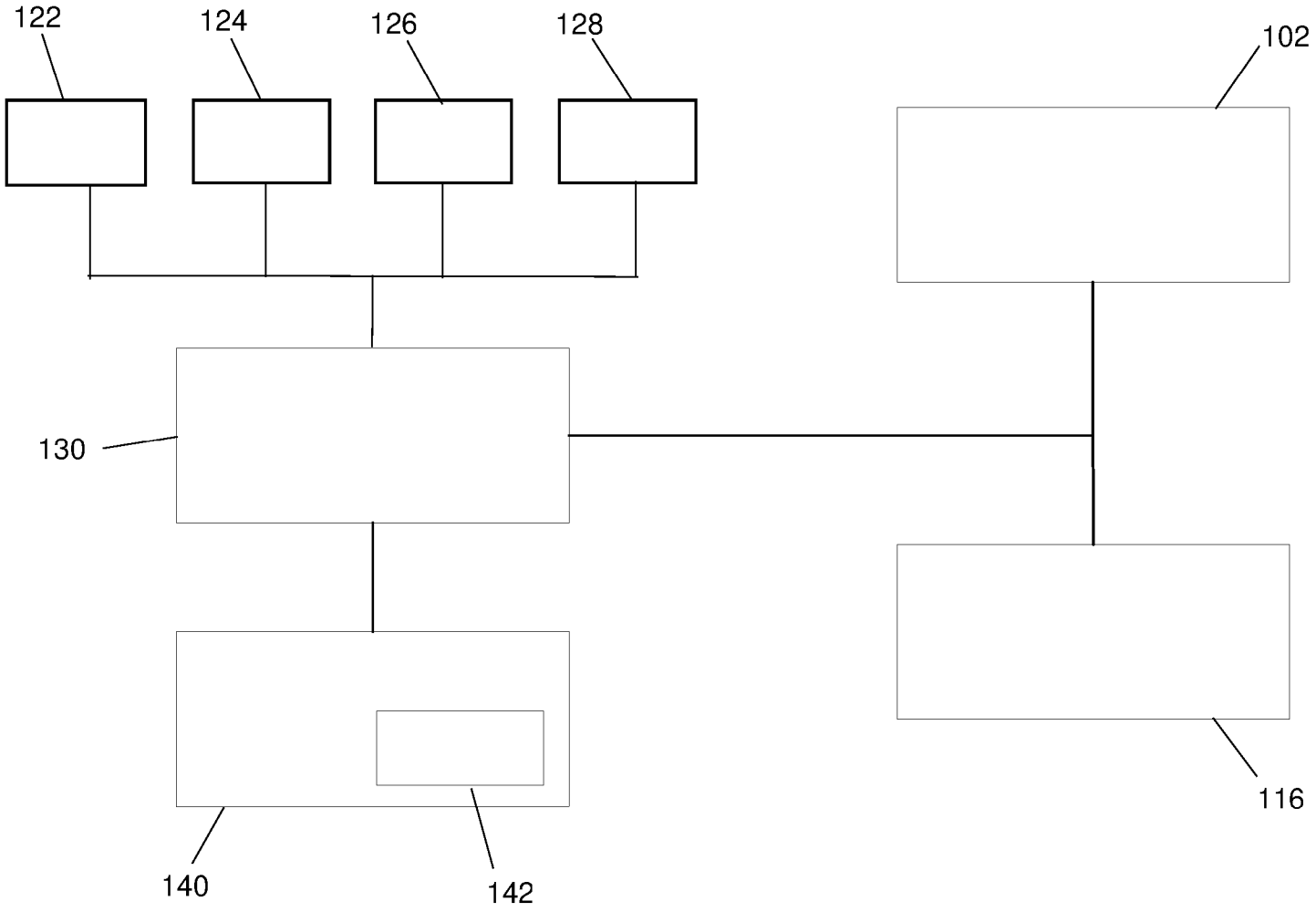
FIG. 1D is a block diagram of an electrical control device of the subassembly of FIG. 1A.

The subassembly 100 further comprises an electrical control device 130, shown in FIG. 1D. The control device 130 controls the first electrical control valve 102 and the second electrical control valve 116 and may be in the form of a processor, a microcontroller, a Field Programmable Gate Array (FPGA) or a different type of calculation mechanism. The control device 130 may also further comprise additional components, such as, for example, a driver for the actuator, etc. The control device 130 is connected to a non-transitory computer readable medium storing instructions thereon that, when executed by the control device 130, perform the functions and control of the control device 130 described below.

The electrical control device 130 controls, during operation of the refrigerating medium compressor, a refrigerating medium flow between the high-pressure region Pd and a crank chamber pressure region Pc by position of the valve member 110 of the first control valve 102. The electrical control device 130 transmits an electrical signal to the first electrical control valve 102 which predetermines the corresponding position of the valve member 110. The electrical control device 130 further controls, during operation of the refrigerating medium compressor, the refrigerating medium flow between the crank chamber pressure region Pc and the suction pressure region Ps by position of the valve member of the second electrical control valve 116. The electrical control device 130 transmits an electrical signal to the second electrical control valve 116 which predetermines the corresponding position of the valve member of the second electrical control valve 116.

The control of the valve member of the second electrical control valve 116 is executed by the electrical control device 130 in accordance with the control of the first electrical control valve 102, that is to say, the position of the valve member of the second control valve 116 is in accordance with the position of the valve member of the first control valve 102. Dependent control of the second control valve 116 is brought about during operation of the refrigerating medium compressor both during the conveying operation and during the no-load operation of the refrigerating medium compressor.

During conveying operation, the refrigerating medium compressor conveys refrigerating medium from the suction pressure region Ps to the high-pressure region Pd. The control device 130 controls the position of the first control valve 102 so that the high-pressure region Pd is separated from the crank chamber pressure region Pc. In this position, the refrigerating medium does not flow into the crank chamber pressure region Pc. At the same time, the control device 130 controls the position of the second control valve 116 so that the crank chamber pressure region Pc is connected to the suction pressure region Ps. The refrigerating medium still located in the crank chamber pressure region Pc flows into the suction pressure region Ps in this position.

During no-load operation, the control device 130 controls the position of the first control valve 102 so that the high-pressure region Pd is connected to the crank chamber pressure region Pc. In this position, the refrigerating medium flows into the crank chamber pressure region Pc so that the swash plate pivots back into a non-tilted position. At the same time, the control device 130 controls the position of the second control valve 116 so that the crank chamber pressure region Pc is separated from the suction pressure region Ps. The refrigerating medium located in the crank chamber pressure region Pc does not flow into the suction pressure region Ps in this position; at the same time, however, the swash plate also cannot pivot out into the tilted start position and remains in the non-tilted position. As a result of the control according to the invention with the control device 130, an increase in efficiency is produced during operation of the refrigerating medium compressor.

The subassembly 100 comprises a first electrical interface 140, shown in FIG. 1D, via which a refrigerating output for the refrigerating medium is predetermined during operation of the refrigerating medium compressor. The electrical control device 130 is adapted so that the first and second control valves 102, 116 are controlled in accordance with the refrigerating output predetermined by the first electrical interface 140. In an exemplary embodiment, the first electrical interface 140 is a Controller Area Network ("CAN") databus. In other embodiments, the first electrical interface 140 is a Serial Peripheral Interface (SPI) databus, an Inter-Integrated Circuit (I2C) databus, or a Local Interconnect Network (LIN) databus.

In another embodiment, the subassembly 100 comprises a second electrical interface 142, shown in FIG. 1D, via which the subassembly 100 is supplied with electrical voltage. The second electrical interface 142 may be separate or integrated in the first electrical interface 140.

In another embodiment, at least one of the first and second electrical control valves 102, 116 comprises an actuation drive 114 which displaces the corresponding valve member between the two positions. Embodiments of the electrical actuation drive 114 include a stepping motor, a direct-current motor, a servomotor, electrical lifting magnet and a piezoelectric drive.

The subassembly 100, in another embodiment shown in FIGS. 1A-1C, comprises a first pressure sensor 122 which establishes a value of the high pressure in the high-pressure region Pd; and/or a second pressure sensor 124 which establishes a value of the suction pressure in the suction pressure region Ps. The electrical control device 130 is adapted so that the first and second control valves 102, 116 are controlled in accordance with the established value of the high pressure and/or the suction pressure.

In another embodiment as shown in FIGS. 1A-1C, the subassembly 100 comprises a first temperature sensor 126 which establishes a value of a temperature of the refrigerating medium in the high-pressure region Pd; and/or a second temperature sensor 128 which establishes a value of a temperature of the refrigerating medium in the suction pressure region Ps. The electrical control device 130 is adapted so that the first and second control valves 102, 116 are controlled in accordance with the established temperature value of the refrigerating medium in the high-pressure region Pd and/or the suction pressure region Ps.

The value of the suction pressure, the value of the high pressure, the value of the temperature in the suction pressure region Ps and the value of the temperature in the high-pressure region Pd are provided by the sensors 122, 124, 126 and 128. Those values can be used to establish the mass flow in the refrigerating medium circuit by the electrical control device 130 shown in FIG. 1D. Using the mass flow, the torque of the refrigerating medium compressor can be calculated. If the current or future torque of the refrigerating medium compressor is known, the injection quantity in the motor vehicle can be adapted more precisely, which results in fuel savings and therefore to reductions of CO2. Furthermore, the belt tension for a known torque can be adjusted in accordance with requirements in the case of controlled belt tensioning members in the motor vehicle. This is advantageous because friction forces are reduced and the service-life of the belt bearings is increased.

In an embodiment of the subassembly 100, the electrical control device 130 is adapted so that, if the refrigerating medium compressor is non-operational (in neither conveying operation nor in no-load operation), the first and second control valves 102, 116 are controlled so that the valve member of the first control valve 110 and the second control valve 102, 116 simultaneously take up a position in which the corresponding high-pressure Pd and suction pressure Ps regions are connected to each other via the crank chamber pressure region Pc. A more efficient operation of the refrigerating medium compressor is possible; the construction-related disadvantages of a conventional refrigerating medium compressor are compensated for by the invention.

Figure 2A:
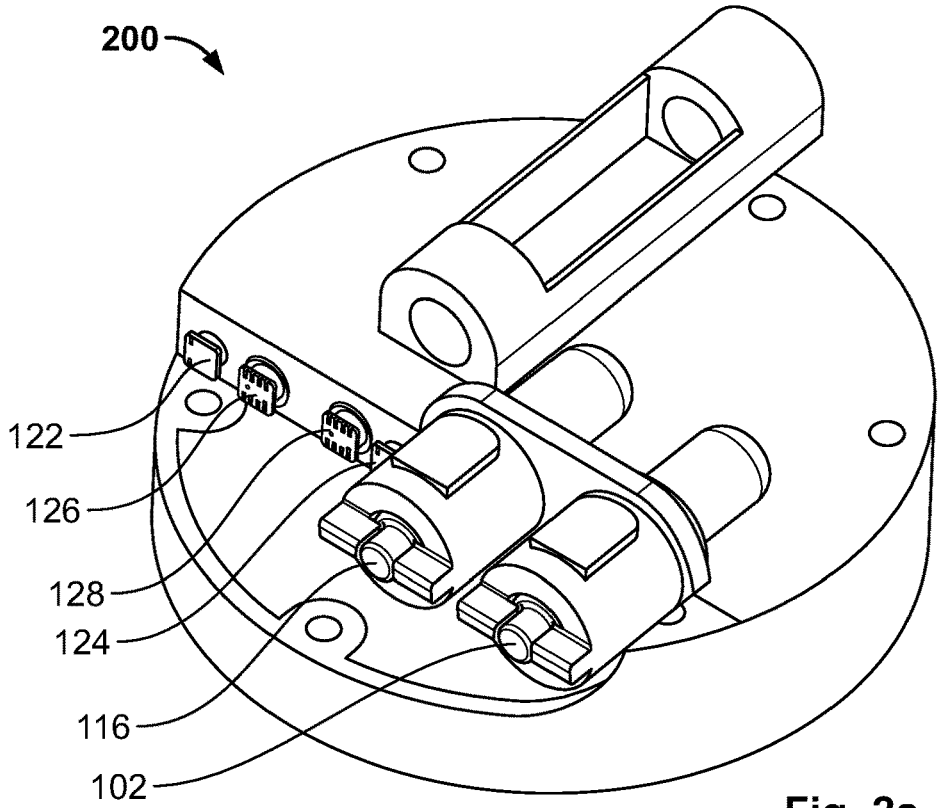
FIG. 2A is a top perspective view of a subassembly for a refrigerating medium compressor according to another embodiment.
Figure 2B:
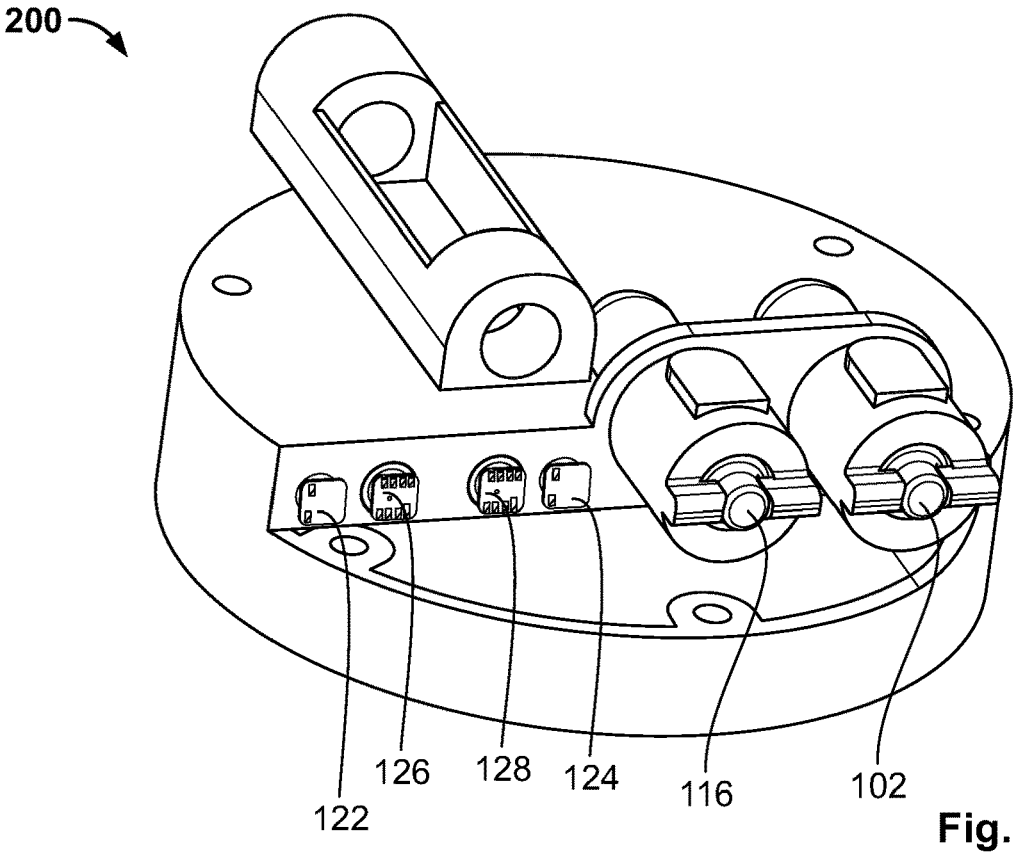
FIG. 2B is a front perspective view of the subassembly of FIG. 2A.
Figure 2C:
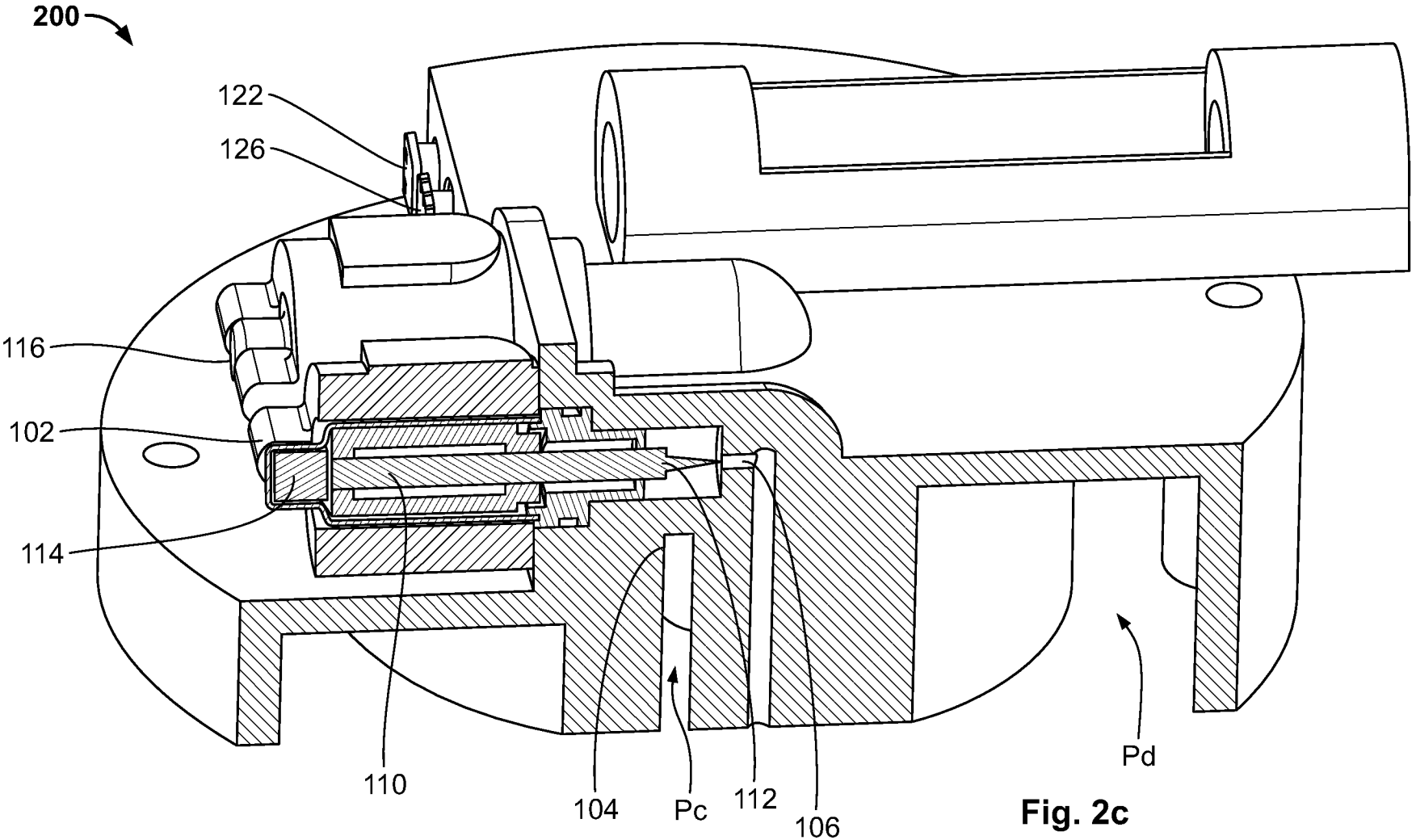
FIG. 2C is a sectional side view of the subassembly of FIG. 2A.

A subassembly 200 for a refrigerating medium compressor according to another embodiment is shown in FIGS. 2A-2C. Like reference numbers indicate like elements, and only differences from the subassembly 100 shown in FIGS. 1A-1C will be described in detail herein.

The subassembly 200 differs from the subassembly 100 only in terms of its arrangement in relation to the portion of the refrigerating medium compressor housing. There is a vertical arrangement of the subassembly 200 in relation to the selected refrigerating medium compressor housing and not, as illustrated in connection with the subassembly 100, a horizontal arrangement. The construction depth of the refrigerating medium compressor with the subassembly 200 in the fitted state can advantageously be reduced.

Figure 3A:
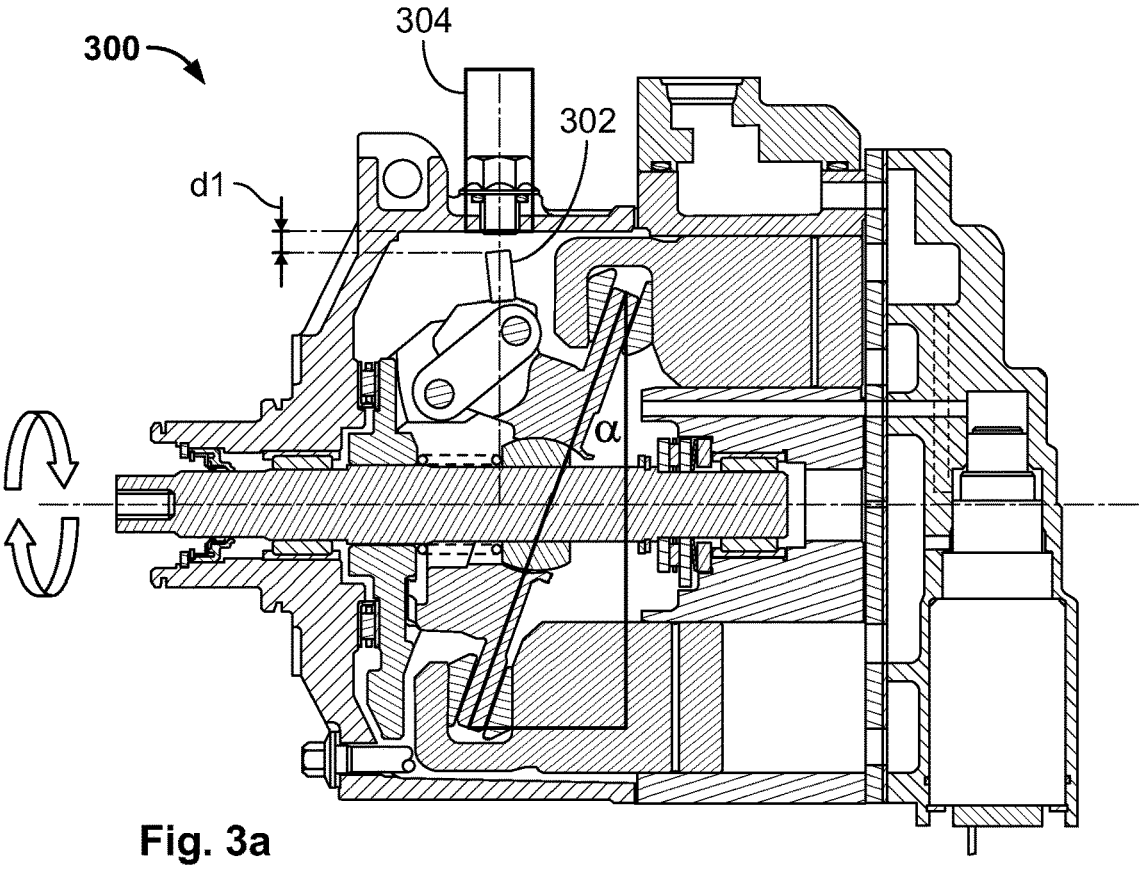
FIG. 3A is a sectional side view of a sensor system for a refrigerating medium compressor according to an embodiment in a first position.
Figure 3B:
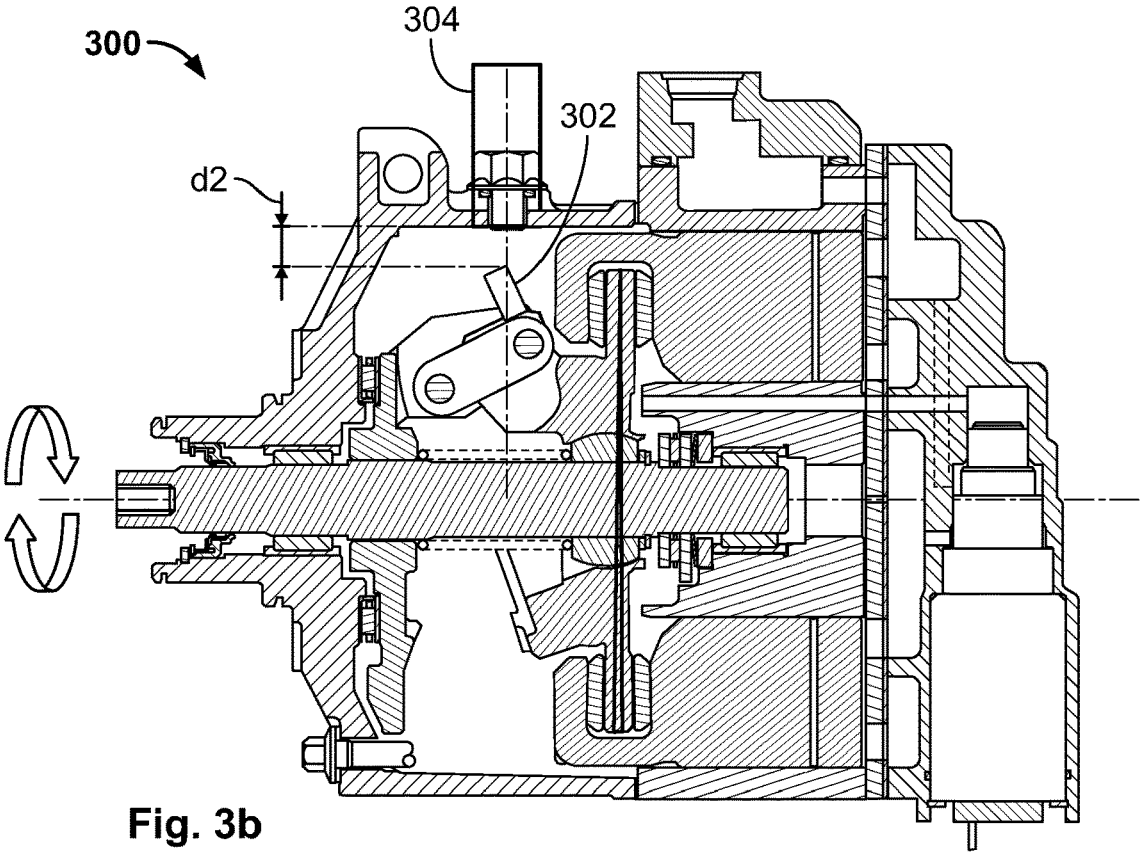
FIG. 3B is a sectional side view of the sensor system of FIG. 3A in a second position.

A sensor system 300 according to an embodiment for a refrigerating medium compressor is shown in FIGS. 3A and 3B. The sensor system 300 is used to establish a rotational speed and a tilting angle of a swash plate in a refrigerating medium compressor, in particular in a motor vehicle.

The refrigerating medium compressor comprises a swash plate which is tiltably supported on a drive shaft and which is driven thereby, and is therefore caused to rotate. In an exemplary embodiment of the refrigerating medium compressor, the drive force is transmitted from the drive shaft of the refrigerating medium compressor to a rotatable carrier disc. A carrier arm which is arranged on the carrier disc and which extends in an axially parallel manner with respect to the drive shaft transmits the drive force via a pivotably supported connection element to the swash plate of the compressor. The swash plate of the refrigerating medium compressor is itself connected to a plurality of pistons via sliding bearings. As a result, a swash plate which is pivoted out at a tilting angle which is different from zero guides the connected pistons during a rotation about the rotation axis in an axial lifting movement. The tilting angle of the swash plate consequently determines the lifting action of the pistons and therefore the conveying volume of the refrigerating medium compressor.

The sensor system 300, as shown in FIGS. 3A and 3B, comprises a position transmitter 302 which is mechanically connected to the swash plate so that the position transmitter 302 carries out a cyclical movement which is dependent on the rotational and tilting movement of the swash plate and which is guided thereby within a housing of the refrigerating medium compressor. A cyclical movement of the position transmitter 302 describes, in connection with the invention, a movement which is repeated in accordance with a rotation of the swash plate about the rotation axis thereof.

Figure 4A:
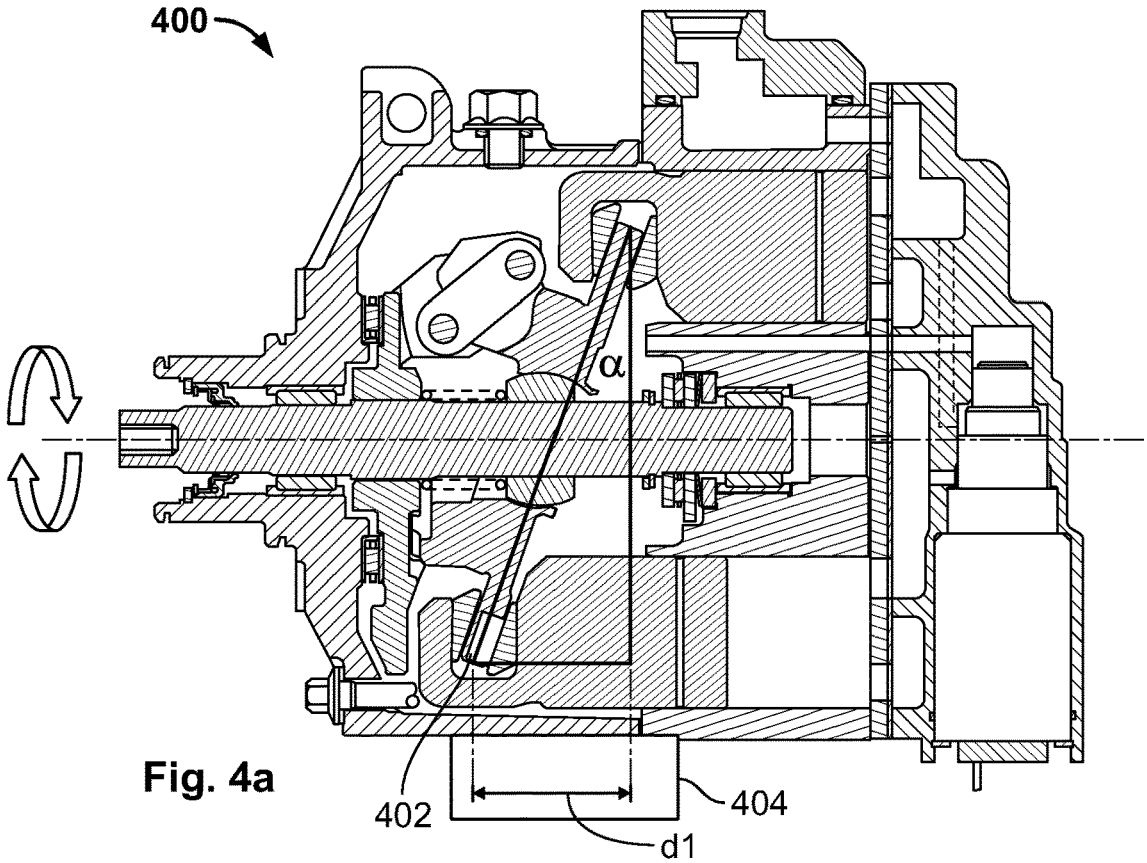
FIG. 4A is a sectional side view of a sensor system for a refrigerating medium compressor according to another embodiment in a first position.
Figure 4B:
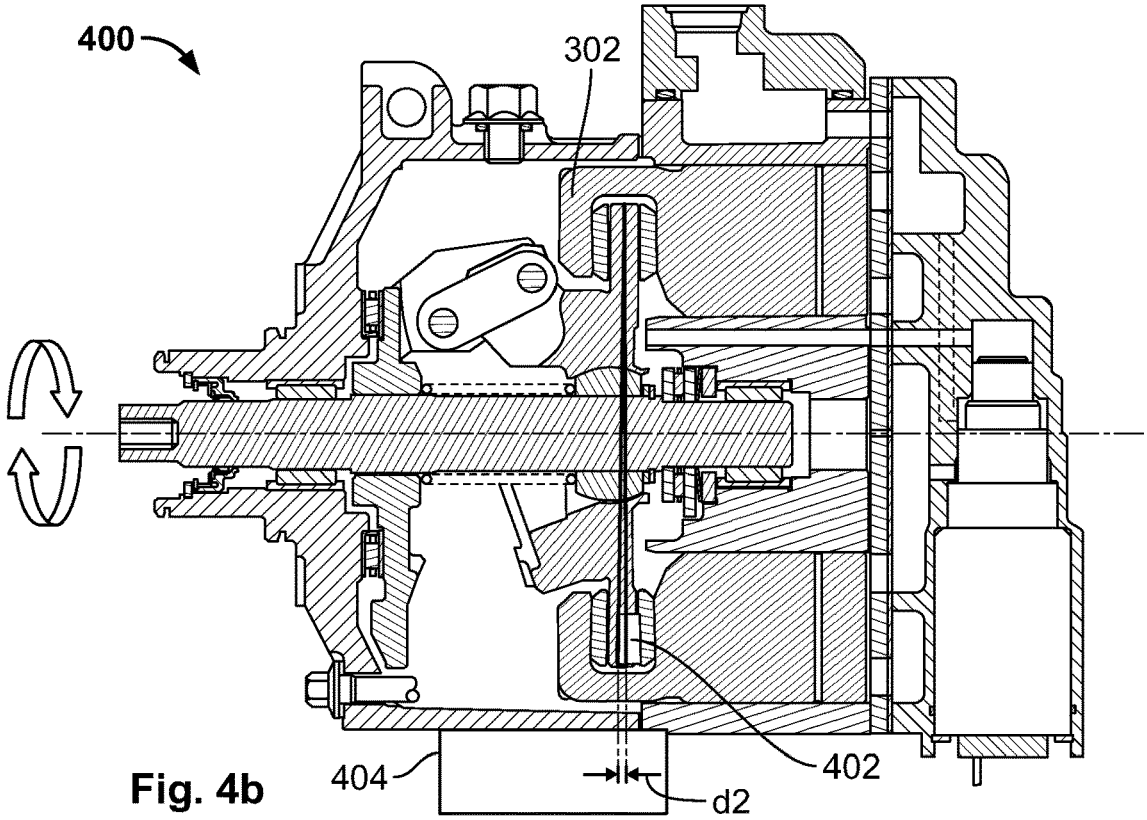
FIG. 4B is a sectional side view of the sensor system of FIG. 4A in a second position.

The position transmitter 302 may be guided either in a repeating swash or tilting movement about the rotation axis, guided on a repeating circular path about the rotation axis, or also guided in a repeating lifting movement parallel with the rotation axis. The cyclical movement of the position transmitter 302 only has to be dependent on the rotational movement of the swash plate and to allow conclusions regarding the tilting angle thereof. The position transmitter 302 can be mechanically connected to a pivotably supported connection element, via which the swash plate is driven, as shown in FIGS. 3A and 3B. In an alternative embodiment, the position transmitter 402 can also be integrated in the swash plate as shown in FIGS. 4A and 4B.

Figure 5A:
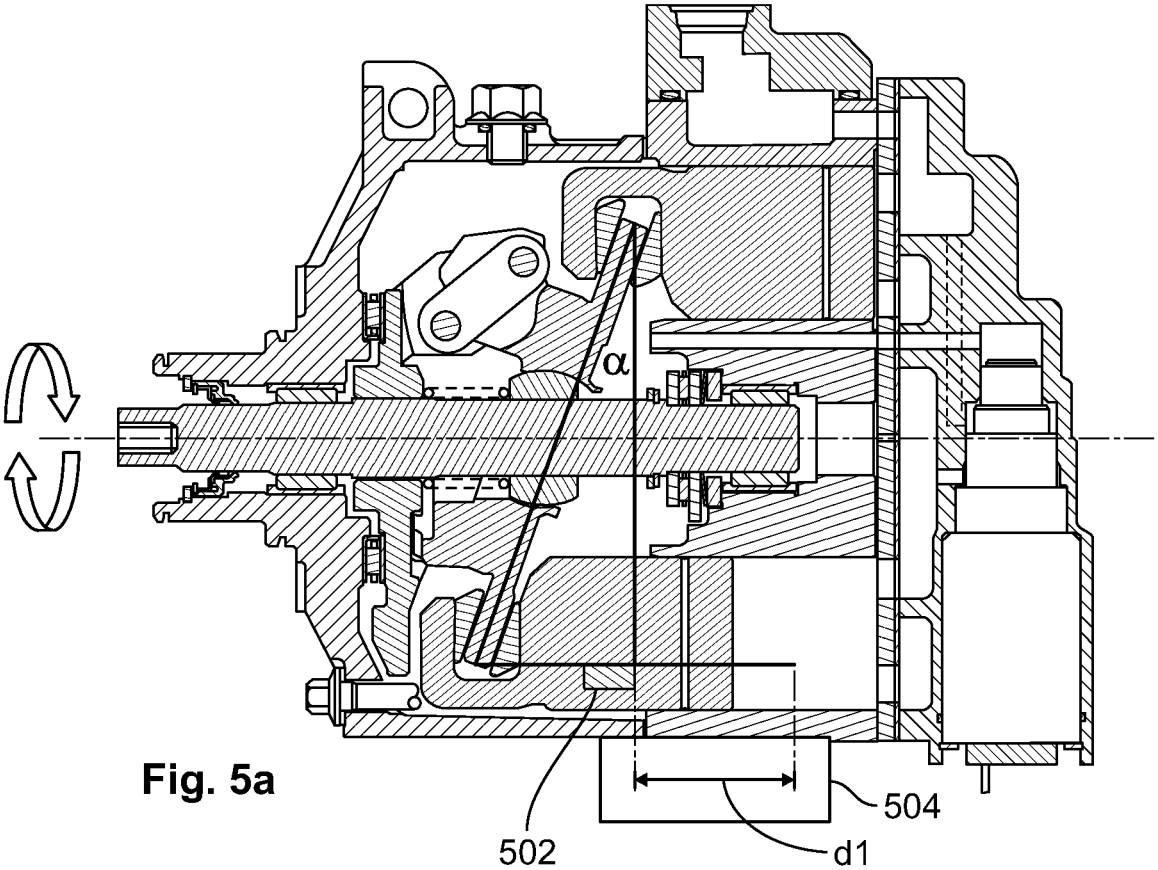
FIG. 5A is a sectional side view of a sensor system for a refrigerating medium compressor according to another embodiment in a first position.
Figure 5B:
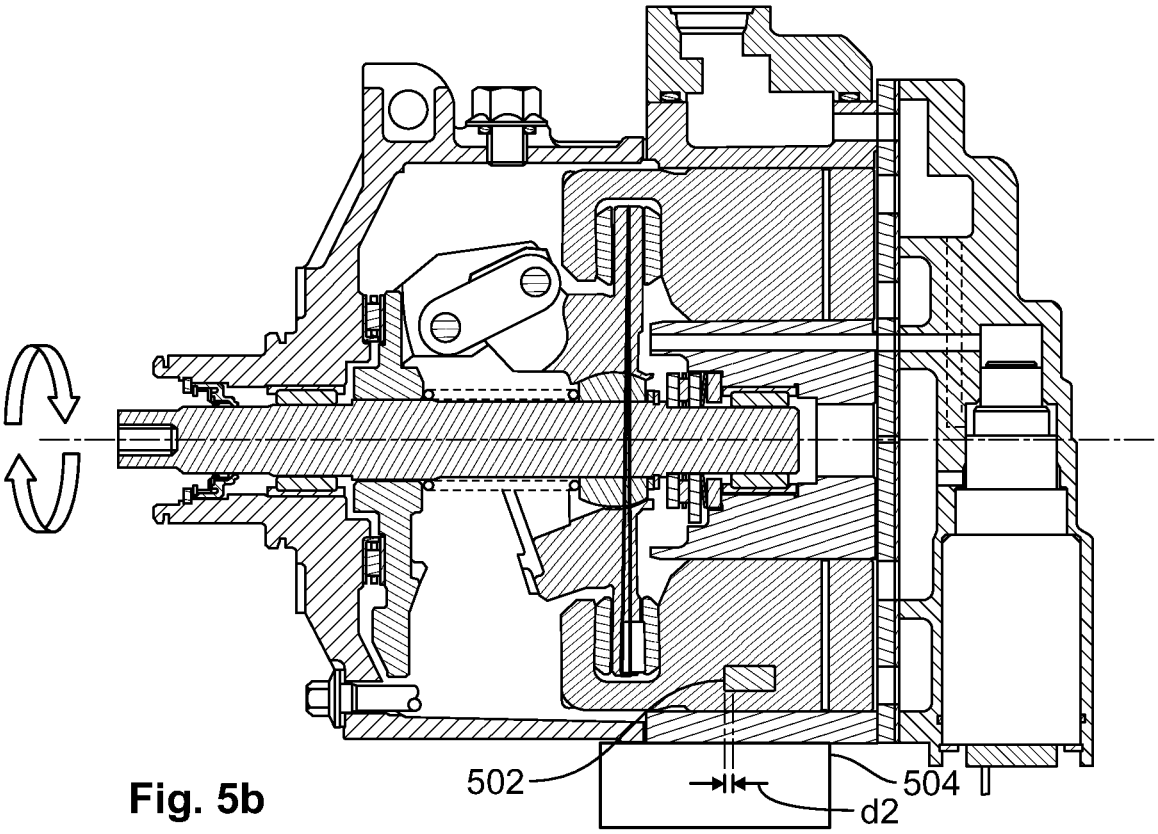
FIG. 5B is a sectional side view of the sensor system of FIG. 5A in a second position.

In an alternative embodiment, the position transmitter is mechanically connected to a piston of the refrigerating medium compressor, which piston is connected to the swash plate, and carries out a translational movement or lifting movement which is dependent on the rotational and tilting movement of the swash plate and which extends substantially parallel with the drive shaft. In this embodiment, the position transmitter can be mechanically connected to a connection element, via which the piston is connected to the swash plate. Alternatively, the position transmitter 502 can also be integrated in the piston as shown in FIGS. 5A and 5B.

The sensor system 300, as shown in FIGS. 3A and 3B, comprises a position sensor 304 which is mechanically connected to the housing of the refrigerating medium compressor. As a result, the position sensor 304 constitutes a fixed reference point for a spacing determination operation, with respect to which the movement of the position transmitter 302 can be understood or established. The position sensor 304 is arranged in such a manner that, at least at one time, that position sensor 304 is located with little spacing from the position transmitter 302 with respect to the guided cyclical movement thereof.

In accordance with one embodiment that the position transmitter 302, as shown in FIGS. 3A and 3B, is guided in a repeating swash or tilting movement about the rotation axis, the required small spacing with respect to the position transmitter 302 corresponds to an arrangement of the position sensor 304 in alignment with at least one point of the rotation axis. In another embodiment shown in FIGS. 4A and 4B, the position sensor 404 is guided about the rotation axis on a repeating circular path, the small spacing with respect to the position transmitter 402 corresponds to an arrangement of the position sensor 404 in alignment with at least one point on the rotation axis. In another embodiment shown in FIGS. 5A and 5B, the position transmitter 502 is guided in a repeating translational movement or lifting movement substantially parallel with the drive shaft, the small spacing with respect to the position transmitter 502 corresponds to an aligned arrangement of the position sensor 504 alongside at least one position of the movement.

The position sensor 304 of the sensor system 300 shown in FIGS. 3A and 3B continuously establishes a spacing between the position transmitter 302 and position sensor 304. The position sensor 304 comprises an evaluation device. The evaluation device may be in the form of a processor, a microcontroller, a Field Programmable Gate Array, FPGA, or a calculation mechanism of another type. The evaluation device selects a minimum spacing between the position transmitter and the position sensor from a plurality of continuously established spacings. That selected minimum spacing is subsequently used to establish a tilting angle from the amplitude thereof and a rotational speed of the swash plate from the time intervals between two successive selected minimum spacings. The evaluation device establishes the tilting angle and the rotational speed of the swash plate of the refrigerating medium compressor from the spacing signal established by the position sensor 304 between the position transmitter 302 and position sensor 304.

The evaluation device selects the spacing values in the spacing signal which correspond to a minimum spacing in relation to a time horizon. The relative time horizon can be selected as the time of a revolution of the swash plate about the rotation axis thereof, and is therefore dependent on the rotational speed. This requires an estimate which can also take into consideration, for example, the history of earlier rotational speeds. Consequently, the time horizon is continuously adapted.

The spacing values selected in the evaluation device correspond to the position of the position transmitter 302 which the position transmitter 302 takes up over the cyclically guided movement with the smallest spacing from the position sensor 304. In the cyclically guided movement, the position transmitter 302 first moves away from the position sensor 304 before it, in accordance with the rotational movement of the swash plate, again moves towards the position sensor 304. Consequently, the time between two successive selected minimum spacing values allows the establishment of the rotational speed of the swash plate.

The evaluation device further establishes the tilting angle of the swash plate via the amplitude of a selected minimum spacing value. The position sensor 304 is arranged at the position at which the redirection by the tilting movement of the swash plate is greatest. In other words, the position transmitter 302 is mechanically connected to the swash plate so that the position transmitter is subjected to a maximum redirection by the tilting movement of the swash plate.

In an embodiment, the position transmitter 302 is constructed as a magnet and the position sensor 304 is constructed as a Hall effect sensor. Other constructions of the sensors are possible. The position sensor 302 is constructed so as to have a housing having a screw thread, and is screwed in a threaded hole which is constructed in the housing of the refrigerating medium compressor. In this instance, the threaded hole which is constructed in the housing can be constructed as a through-hole or a blind hole.

The speed and the compression volume can be established by the corresponding sensor system 300. If the tilting angle and the rotational speed are established, an electrical control device which is provided in the refrigerating medium compressor or the above described electrical control device 130 of the subassembly 100 or 200 can use them to establish the mass flow in the refrigerating medium circuit. Using the mass flow, the torque of the refrigerating medium compressor can be calculated. If the current or future torque of the refrigerating medium compressor is known, the injection quantity can be adapted more precisely in the motor vehicle, which results in fuel savings and therefore to reductions of CO2. Furthermore, the belt tension for a known torque can be adjusted in accordance with requirements in the case of controlled belt tensioning members in the motor vehicle. This is advantageous because friction forces are reduced and the service life of the belt bearings is increased.

A sensor system 400 for a refrigerating medium compressor according to another embodiment is shown in FIGS. 4A and 4B. The sensor system comprises a position transmitter 402 and a position sensor 404 which provide the same functionality as the corresponding position transmitter 302 and the position sensor 304. Only the differences of the sensor system 400 with respect to the sensor system 300 will be described in detail herein.

The sensor system 400 differs from the sensor system 300 only in terms of the arrangement of the position transmitter 402 and the position sensor 404 in/on the refrigerating medium compressor. In particular, the position transmitter 402 is integrated in the swash plate in the sensor system 400. In a corresponding manner, the position sensor 404 is arranged in this example in the sensor system with little spacing from the position transmitter 402 and in alignment with at least one point on the rotation axis on the refrigerating medium compressor housing wall. The rotational speed and the tilting angle of a swash plate in a refrigerating medium compressor are also established in a sufficiently precise manner in this arrangement of the sensor system 400 in/on the refrigerating medium compressor.

A sensor system 500 for a refrigerating medium compressor according to another embodiment is shown in FIGS. 5A and 5B. The sensor system comprises a position transmitter 502 and a position sensor 504 which provide the same functionality as the corresponding position transmitter 302 and the position sensor 304. Only the differences of the sensor system 500 with respect to the sensor system 300 will be described in detail herein.

The sensor system 500 differs from the sensor system 300 only in terms of the arrangement of the position transmitter 502 and the position sensor 504 in/on the refrigerating medium compressor. In particular, the position transmitter 502 is integrated in the piston of the refrigerating medium compressor in the sensor system 500. In a corresponding manner, the position sensor 504 is arranged in the sensor system with little spacing from the position transmitter and in an aligned arrangement alongside at least one position of the movement on the refrigerating medium compressor housing wall. The rotational speed and the tilting angle of a swash plate in a refrigerating medium compressor are also established in a sufficiently precise manner in this arrangement of the sensor system 500 in/on the refrigerating medium compressor.

What is claimed is:

1. A subassembly for a compressor that controls a fluid flow of a fluid between a high-pressure region and a crank chamber pressure region and between the crank chamber pressure region and a suction pressure region of the compressor, comprising:

a first electrical control valve having:

a first valve housing with a plurality of first connections for the high-pressure region and for the crank chamber pressure region, and a first valve member arranged within the first valve housing and which can be displaced between an open position and a closed position in which the first valve member either connects the high-pressure region and the crank chamber pressure region to each other or separates the high-pressure region and the crank chamber pressure region from each other;

a second electrical control valve having:

a second valve housing with a plurality of second connections for the crank chamber pressure region and for the suction pressure region, and a second valve member which is arranged within the second valve housing and which can be displaced between an open position and a closed position in which the second valve member either connects the crank chamber pressure region and the suction pressure region or separates the crank chamber pressure region and the suction pressure region from each other;

a high-pressure temperature sensor establishing a temperature of the fluid in the high-pressure region and a suction pressure temperature sensor establishing a temperature of the fluid in the suction pressure region;

a high pressure sensor establishing a high pressure value in the high-pressure region and a suction pressure sensor establishing a suction pressure value in the suction pressure region; and an electrical control device adapted to control, during operation of the compressor, the fluid flow between the high-pressure region and the crank chamber pressure region by controlling a position of the first valve member between the open position and the closed position of the first valve member, and adapted to control the fluid flow between the crank chamber pressure region and the suction pressure region by controlling a position of the second valve member between the open position and the closed position of the second valve member in accordance with the control of the first control valve, the electrical control device connected to the high-pressure sensor and/or the suction pressure sensor, the electrical control device controls the first valve member and the second valve member to connect the high-pressure region and the suction pressure region via the crank chamber pressure region in a non-operational state of the compressor.

2. The subassembly of claim 1, wherein the electrical control device controls the first valve member to connect the high-pressure region and the crank chamber pressure region and controls the second valve member to separate the crank chamber pressure region and the suction pressure region in a no-load operation of the compressor.

3. The subassembly of claim 1, further comprising an output electrical interface via which an output for the fluid is predetermined during operation of the compressor and/or a supply electrical interface via which the subassembly is supplied with an electrical voltage, the electrical control device is adapted so that the first electrical control valve and the second electrical control valve are controlled in accordance with the output predetermined by the output electrical interface.

4. The subassembly of claim 3, wherein the output electrical interface is a databus.

5. The subassembly of claim 1, wherein the first electrical control valve and the second electrical control valve includes an electrical actuation drive, the electrical actuation drive of the first electrical control valve displaces the first valve member between the open position and the closed position of the first valve member and/or the electrical actuation drive of the second electrical control valve displaces the second valve member between the open position and the closed position of the second valve member.

6. The subassembly of claim 5, wherein the position of the first valve member and/or the position of the second valve member is determined in accordance with one or more actuation variables which are applied to the electrical actuation drive.

7. The subassembly of claim 5, wherein the electrical actuation drive displaces the first valve member in a plurality of positions between the open position and the closed position of the first valve member or displaces the second valve member in a plurality of positions between the open position and the closed position of the second valve member.

8. A compressor, comprising:

a subassembly that controls a fluid flow of a fluid between a high-pressure region and a crank chamber pressure region and between the crank chamber pressure region and a suction pressure region of the compressor, comprising:

a first electrical control valve having a first valve housing with a plurality of first connections for the high-pressure region and for the crank chamber pressure region, and a first valve member arranged within the first valve housing and which can be displaced between an open position and a closed position in which the first valve member either connects the high-pressure region and the crank chamber pressure region to each other or separates the high-pressure region and the crank chamber pressure region from each other;

a second electrical control valve having a second valve housing with a plurality of second connections for the crank chamber pressure region and for the suction pressure region, and a second valve member which is arranged within the second valve housing and which can be displaced between an open position and a closed position in which the second valve member either connects the crank chamber pressure region and the suction pressure region or separates the crank chamber pressure region and the suction pressure region from each other;

a high-pressure temperature sensor establishing a temperature of the fluid in the high-pressure region and a suction pressure temperature sensor establishing a temperature of the fluid in the suction pressure region;

a high pressure sensor establishing a high pressure value in the high-pressure region and a suction pressure sensor establishing a suction pressure value in the suction pressure region; and an electrical control device adapted to control, during operation of the compressor, the fluid flow between the high-pressure region and the crank chamber pressure region by controlling a position of the first valve member between the open position and the closed position of the first valve member, and adapted to control the fluid flow between the crank chamber pressure region and the suction pressure region by controlling a position of the second valve member between the open position and the closed position of the second valve member in accordance with the control of the first control valve the electrical control device connected to the high-pressure sensor and/or the suction pressure sensor, the electrical control device controls the first valve member and the second valve member to connect the high-pressure region and the suction pressure region via the crank chamber pressure region in a non-operational state of the compressor.

9. The compressor of claim 8, further comprising a sensor system for establishing a rotational speed, a piston lifting action and/or a tilting angle of a swash plate in the compressor, the swash plate is tiltably supported on a drive shaft and is driven thereby and caused to rotate, the sensor system comprising:

a position transmitter mechanically connected to the swash plate so that the position transmitter carries out a cyclical movement dependent on rotational and tilting movement of the swash plate and guided within a housing of the compressor; and a position sensor mechanically connected to the housing of the compressor so that the position sensor is arranged with a small spacing from the position transmitter with respect to the guided cyclical movement of the position transmitter and which continuously establishes the spacing between the position transmitter and the position sensor, the position sensor includes an evaluation device which selects a minimum spacing between the position transmitter and the position sensor from a plurality of the continuously established spacings, the evaluation device establishes a tilting angle from an amplitude of the selected minimum spacing and a rotational speed of the swash plate from the time interval between two successive selected minimum spacings.

* * * * *